US006054388A

United States Patent [19]

Saito et al.

[11] Patent Number: 6,054,388

[45] Date of Patent: Apr. 25, 2000

[54] APPARATUS FOR LAPPING SEMICONDUCTOR WAFERS AND METHOD OF LAPPING THEREOF

[75] Inventors: Kyuzo Saito; Yoshiaki Oono; Yoshiichirou Iwakiri; Hironobu Taniguchi, all of Kanagawa, Japan

[73] Assignee: Komatsu Electronics Metals Co., Ltd., Kanagawa, Japan

[21] Appl. No.: 08/899,478

[22] Filed: Jul. 24, 1997

[30] Foreign Application Priority Data

Jul. 24, 1996 [JP] Japan ..... 8-227328

[51] Int. Cl.[7] ..... H01L 21/302

[52] U.S. Cl. ..... 438/692

[58] Field of Search ..... 451/286, 287; 438/691, 692, 693

[56] References Cited

U.S. PATENT DOCUMENTS

| | | | |
|---|---|---|---|
| 4,773,185 | 9/1988 | Taira | 51/118 |
| 5,099,614 | 3/1992 | Arai et al. | 51/165 |
| 5,159,787 | 11/1992 | Suenaga et al. | 51/326 |
| 5,364,655 | 11/1994 | Nakamura et al. | 427/129 |
| 5,679,055 | 10/1997 | Green et al. | 451/10 |
| 5,800,725 | 9/1998 | Kata et al. | 438/692 |
| 5,821,167 | 10/1998 | Fukami et al. | 438/692 |

FOREIGN PATENT DOCUMENTS

| | | | |
|---|---|---|---|
| 3-251363 | 11/1991 | Japan | B24B 37/04 |

*Primary Examiner*—Benjamin L. Utech
*Assistant Examiner*—Duy-Vu Deo
*Attorney, Agent, or Firm*—Sughrue, Mion, Zinn, Macpeak & Seas, PLLC

[57] ABSTRACT

To provide a semiconductor wafer lapping method capable of preventing deformation of a press platen caused by repeating lapping and improving deterioration of TTV caused by rotation stop of semiconductor wafers. In a semiconductor wafer lapping method comprising the steps of placing a lapping carrier having holding holes loaded with semiconductor wafers between an upper press platen and a lower press platen which rotate in opposite directions, rotating the lapping carrier, and lapping the semiconductor wafers, the rotation speed of the lapping carrier is abruptly changed to induce rotation of the semiconductor wafers in the holding holes of the lapping carrier.

11 Claims, 10 Drawing Sheets

APPARATUS FOR LAPPING SEMICONDUCTOR WAFERS AND METHOD OF LAPPING THEREOF

BACKGROUND OF THE INVENTION

1. Field of the Invention

This invention relates to an apparatus for lapping semiconductor wafers and a method of lapping thereof and more particularly to a semiconductor wafer lapping method of lapping sliced wafers.

2. Description of the Related Art

A sliced semiconductor wafer is chamfered, then the sliced surface of the semiconductor wafer is shaped by lapping or surface grinding.

The lapping is batch processing of a plurality of semiconductor wafers and is the best in processing efficiency. As shown in FIG. 4, in the lapping, a lapping carrier 4 having holding holes loaded with a plurality of semiconductor wafers is placed between an upper press platen 31 (not shown) and a lower press platen 3 which generally rotate in opposite directions, and is rotated by the rotation difference between a sun gear 51 and an internal gear 52 and is making sun-and-planet motion relative to the upper press platen 31 and the lower press platen 3 for lapping the semiconductor wafers 10. At the time, the semiconductor wafers 10 themselves also rotate and are flat ground.

For the rotation directions of the lapping carrier 4, the direction opposed to the rotation of the lower press platen 3 is forward rotation (arrow X) and its opposite direction is reverse rotation (arrow Y).

When the upper and lower press platens are mounted on a lapping apparatus, their surfaces are not necessarily flat and when lapping is repeated, the surface shapes furthermore change like a convex lower press platen 3*a* called "A" warpage as shown in FIG. 7(*a*) or a concave lower press platen 3*a* called "B" warpage as shown in FIG. 7(*c*). The upper press platen rotates following the shape of the lower press platen due to the tare weight of the upper press platen, thus the shape of the upper press platen depends on the shape of the lower press platen.

As a method of correcting the warpage of the press platen surface to a flat surface as shown in FIG. 7(*b*), the shape is measured, for example, once a day or a week, a correction carrier (not shown) is placed in place of the lapping carrier, and the lapping apparatus is rotated, whereby the press platen is shaped flat.

In this method, for the "A" warpage (convex), if the correction carrier is forward rotated with respect to the lower press platen 3 (arrow X :positive rotation), the hatched parts of the lower press platen are easily ground and the warpage is furthermore enlarged, as shown in FIG. 8(*a*). On the other hand, the correction carrier is reversely rotated with respect to the lower press platen 3 (arrow Y: negative rotation), whereby the portion corresponding to the projection of the lower press platen 3 is easily ground and the lower press platen 3 can be made almost flat, as shown in FIG. 8(*b*). In contrast, for the "B" warpage (concave), the correction carrier is forward rotated with respect to the lower press platen 3 (arrow X), whereby the lower press platen 3 can be made almost flat.

However, the shaping of the press platen using the correction carrier is poor in work efficiency, thus the measurement and shaping frequencies must be lessened. Meanwhile, the flatness of lapped semiconductor wafers is impaired gradually as the lapping is repeated.

Then, in the conventional lapping, a method of alternately inverting the lapping carrier rotation direction is proposed in Japanese Patent Laid-Open No. Hei 3-251363. This method can prevent the press platen from becoming deformed at the initial stage of the lapping process.

However, such semiconductor wafers ground in batch, which differ from each other slightly in thickens, come in contact with the upper and lower press platens in a projection area from the lapping carrier face and rotate due to friction; when lapping is repeated and the thickness becomes uniform, most semiconductor wafers do not rotate as they are sandwiched between the upper and lower press platens. Thus, as shown in FIG. 4, the same extensions 10*a* of the semiconductor wafers 10 are lapped while they extend off the lower press platen 3. Then, as shown in FIG. 11, only the portion abutting the marginal portion of the upper press platen 31 is much lapped and the extension 10*a* and an inner peripheral portion 10*b* positioned in the inner peripheral portions of the upper and lower press platens 3 and 31 are not much lapped, producing a recess 20*a* in the outer peripheral portion, resulting in a shape as shown in FIG. 10; the total thickness variation (TTV)TTV becomes a large value.

SUMMARY OF THE INVENTION

It is therefore an object of the invention to provide a semiconductor wafer lapping apparatus and method capable of preventing deformation of a press platen caused by repeating lapping and improving deterioration of TTV caused by rotation stop of semiconductor wafers. To the end, according to a first aspect of the invention, there is provided, in a semiconductor wafer lapping method comprising the steps of placing a lapping carrier having holding holes loaded with semiconductor wafers between an upper press platen and a lower press platen which rotate in opposite directions each other, rotating the lapping carrier, and lapping the semiconductor wafers, the improvement wherein the rotation speed of the lapping carrier is abruptly changed to induce rotation of the semiconductor wafers in the holding holes of the lapping carrier.

In a second aspect of the invention, the rotation speed of the lapping carrier is changed digitally.

In a third aspect of the invention, a change rate of the rotation speed of the lapping carrier is 0.1 rpm/second or more in the first invention.

In a fourth aspect of the invention, a change rate of the rotation speed of the lapping carrier is 1.0 rpm/second or more in the first invention.

According to a fifth aspect of the invention, there is provided, in a semiconductor wafer lapping method comprising the steps of placing a lapping carrier having holding holes loaded with semiconductor wafers between an upper press platen and a lower press platen which rotate in opposite directions, rotating the lapping carrier, and lapping the semiconductor wafers, the improvement wherein the lapping carrier is controlled so as to rotate alternately in forward and reverse directions and rotate in the forward direction at the last step.

In a sixth aspect of the invention, the rotation speed of the lapping carrier is changed digitally.

In a seventh aspect of the invention, the rotation speed of the lapping carrier after inversion is held substantially constant and rotation in one direction is maintained for at least five seconds.

According to a eighth aspect of the invention, there is provided, in a semiconductor wafer lapping method comprising the steps of placing a lapping carrier having holding holes loaded with semiconductor wafers between an upper press platen and a lower press platen which rotate in opposite directions, rotating the lapping carrier, and lapping the semiconductor wafers, the improvement comprising the steps of measuring a shape of the lower press platen before lapping is started, calculating a rotation direction of the lapping carrier and the total rotation time in each rotation direction so that a self-correction of deformation of the lower press platen is made from the measurement result, and setting so that the lapping carrier rotate alternately in forward and reverse directions and the rotation time in the forward direction and the rotation time in the reverse direction become substantially the same as the calculated rotation time based on the calculation result and lapping the semiconductor wafers while making a self-correction of deformation of the lower press platen.

In an ninth aspect of the invention, the lapping step controls so that the rotation direction of the lapping carrier becomes forward at the last step.

In a tenth aspect of the invention, the rotation speed of the lapping carrier is changed digitally.

In a eleventh aspect of the invention, the rotation speed of the lapping carrier after inversion is held substantially constant and rotation in one direction is maintained for at least five seconds.

According to a twelfth aspect of the invention, there is provided a semiconductor wafer lapping apparatus comprising an upper press platen and a lower press platen which rotate in opposite directions, a lapping carrier being mounted between the upper and lower press platens and having holding holes loaded with semiconductor wafers one by one, a sun gear and an internal gear being mounted so as to gear into a margin of the lapping carrier for coaxially rotating having a rotation difference so as to rotate the lapping carrier, and control means for separately controlling rotation of the sun gear and rotation of the internal gear and abruptly changing the rotation difference between the sun gear and the internal gear, thereby controlling rotation of the lapping carrier so as to induce rotation of the semiconductor wafers in the holding holes.

In an thirteenth aspect of the invention, the semiconductor wafer lapping apparatus further includes surface detection means for detecting flatness of a surface of the lower press platen, wherein the control means controls the rotation speed of the lapping carrier in response to output of the surface detection means before lapping.

In the invention, a self correction of uneven shapes of press platens of a lapping apparatus, particularly an uneven shape of the surface of a lower press platen is made by lapping without using a correction carrier for preventing deterioration of TTV increased as the lapping is repeated.

In the conventional lapping, it is considered that if the rotation speed of a lapping carrier is abruptly changed, semiconductor wafers are easily broken or chip due to shock; it is usually considered that the rotation speed should be changed gradually. From various experiment results, the inventors et al. find that semiconductor wafers are efficiently rotated by abruptly changing the rotation speed of the lapping carrier in lapping, and focus attention on this point. Semiconductor wafers are efficiently rotated, whereby the abutment positions of the semiconductor wafers against upper and lower press platens can be moved. Thus, in the invention, the rotation speed of the lapping carrier is abruptly changed, semiconductor wafers are rotated for moving the abutment positions of the semiconductor wafers against the upper and lower press platens, thereby lessening TTV values.

Further, as a result of various experiments, the inventions et al. find that if the rotation direction of the lapping carrier is forward(positive), semiconductor wafers are dented in small amounts, that TTV is small, and that flaws are also lessened, and find that if the rotation direction of the lapping carrier is reverse(negative), the semiconductor wafer surfaces are dented in large amounts and that flaws easily occur although the semiconductor wafers are lapped at high speed, and focus attention on the points. That is, as shown in FIG. 8(*a*) and (*b*), the inventors et al. consider that the reason is that a friction portion when the rotation direction of the lapping carrier is forward differs from a friction portion when the rotation direction of the lapping carrier is reverse. Then, focusing attention on the point, control is performed so that semiconductor wafers are lapped while the rotation direction is inverted and that the lapping ends with the forward rotation mode, whereby semiconductor wafers less dented on the surfaces and less flawed can be provided.

DESCRIPTION OF THE PREFERRED EMBODIMENT

Referring now to the accompanying drawings, there are shown preferred embodiments of the invention.

Figure 1:
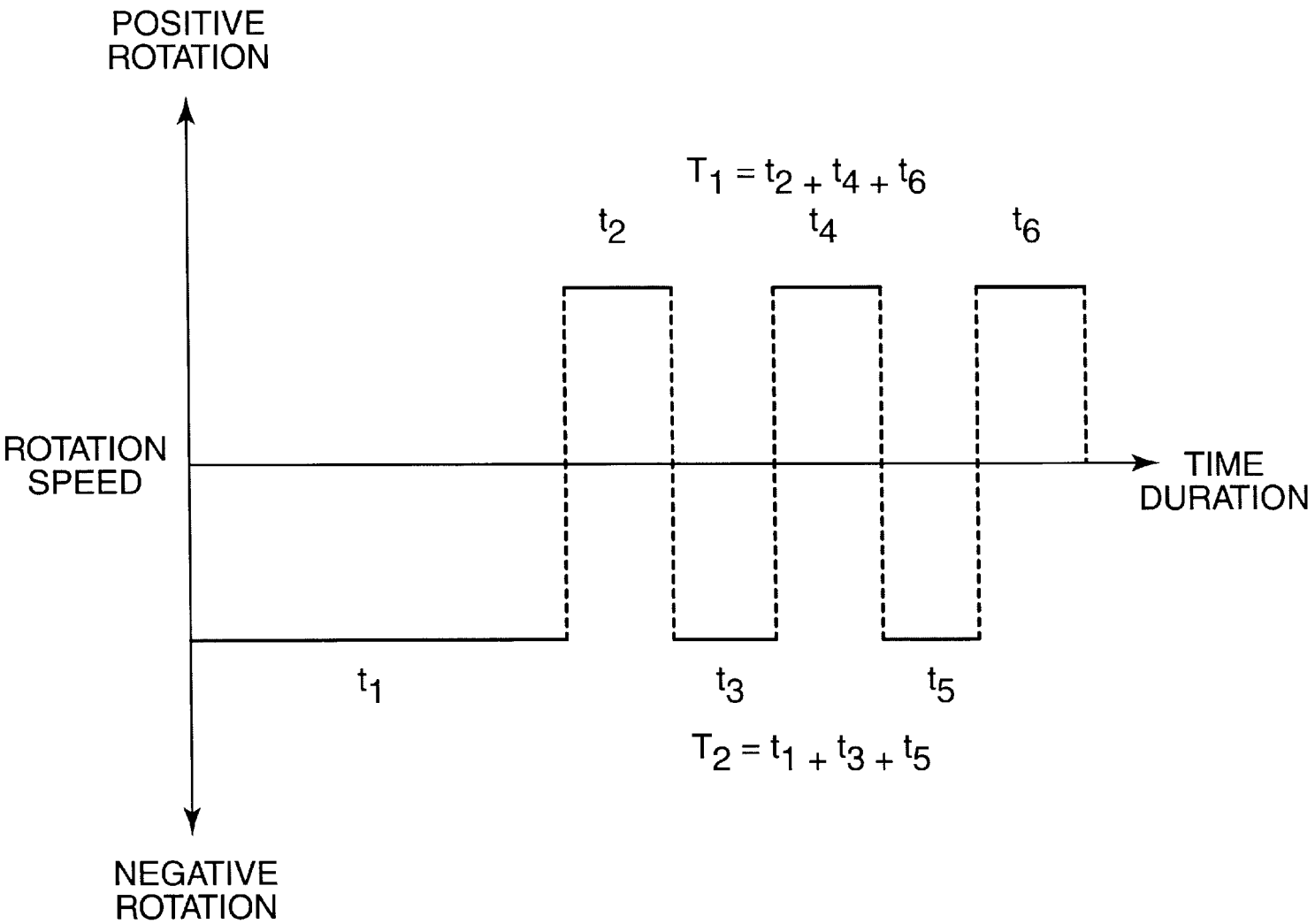
FIG. 1 is a graph to show the rotation direction and rotation speed of a lapping carrier in a grinding method according to the invention.
Figure 2:
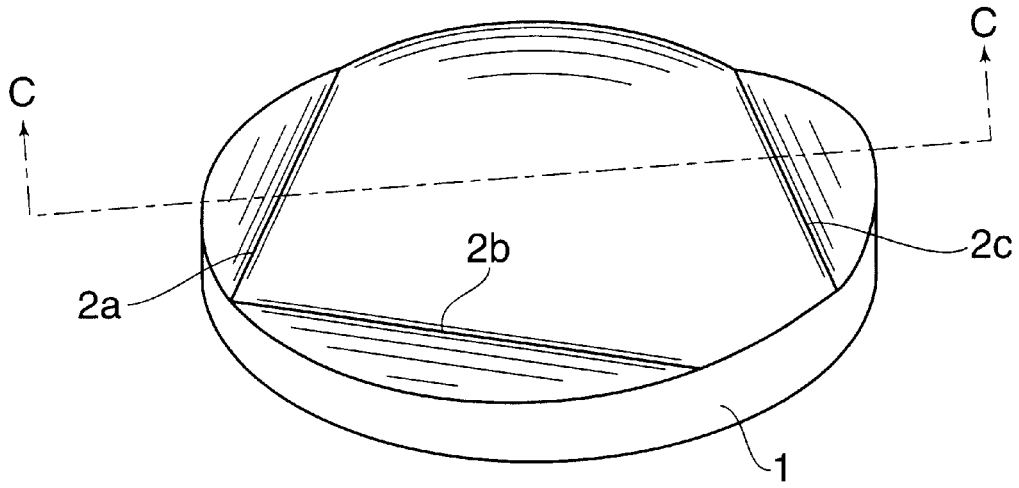
FIG. 2 is a perspective view of a semiconductor wafer provided by the grinding method of an embodiment.
Figure 3:
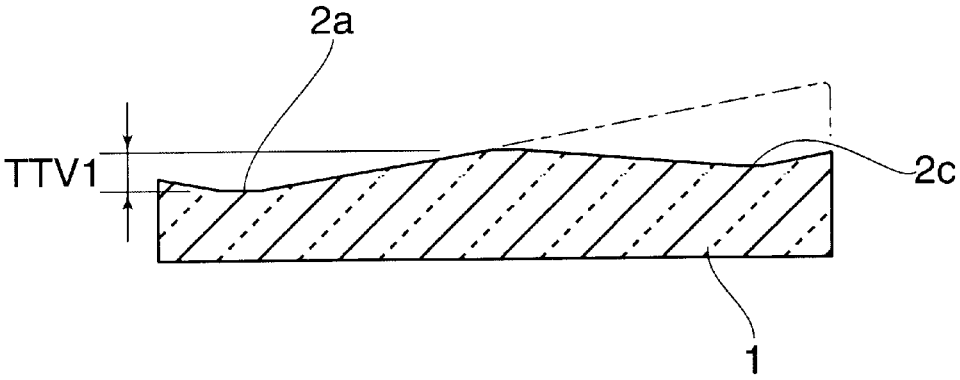
FIG. 3 is a sectional view taken on line C—C in FIG. 2.
Figure 4:
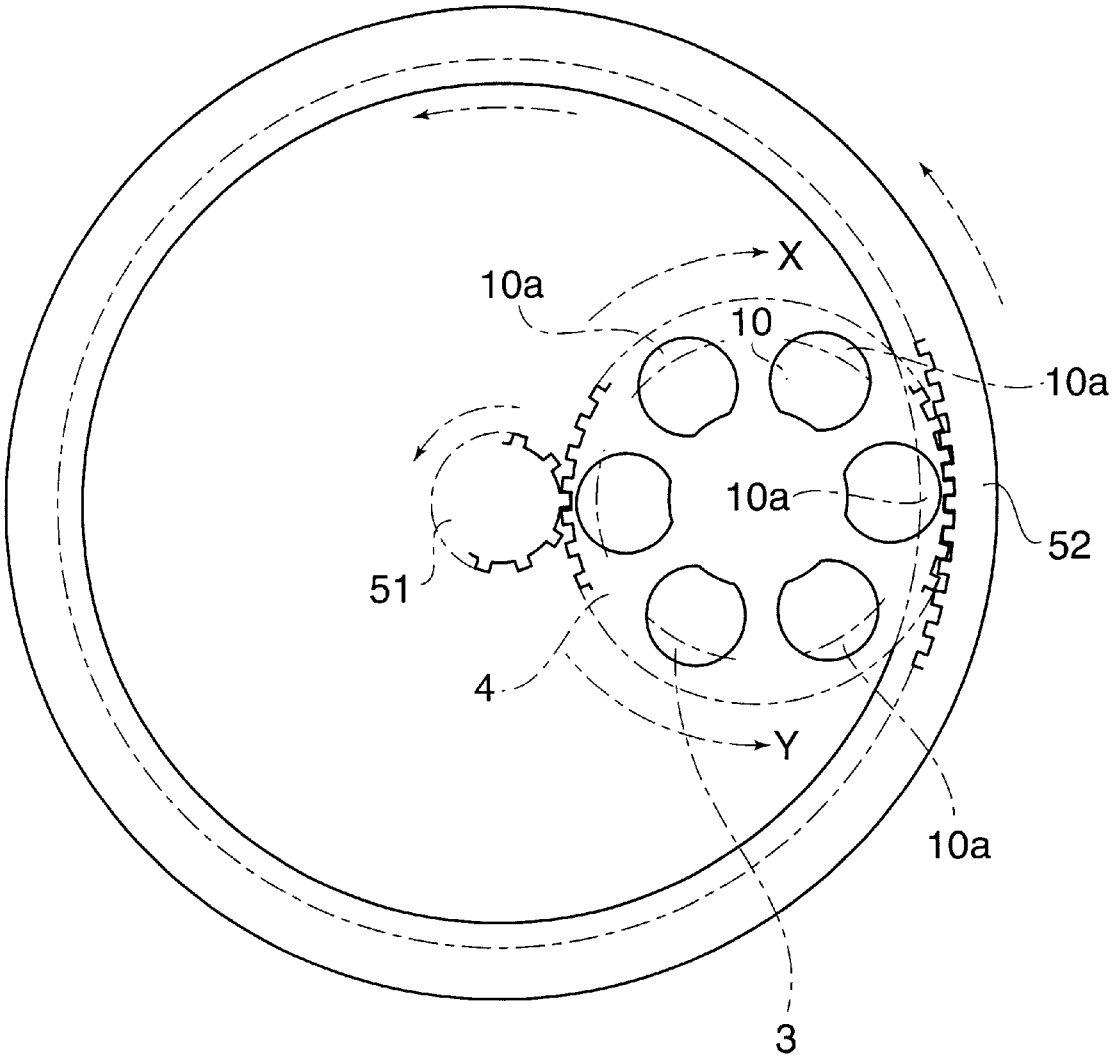
FIG. 4 is a plan view to show a lapping apparatus used with the embodiment of the invention and the rotation directions in lapping.
Figure 5:
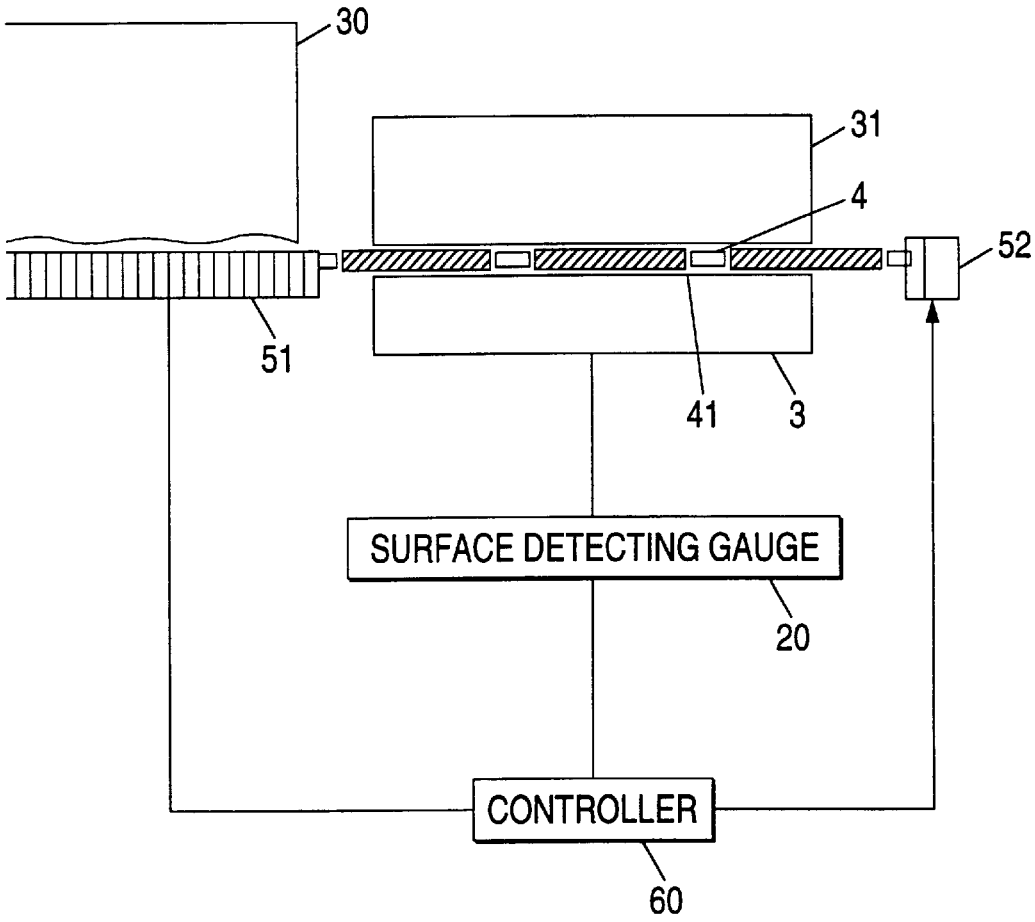
FIG. 5 is illustration of the lapping apparatus.
Figure 6:
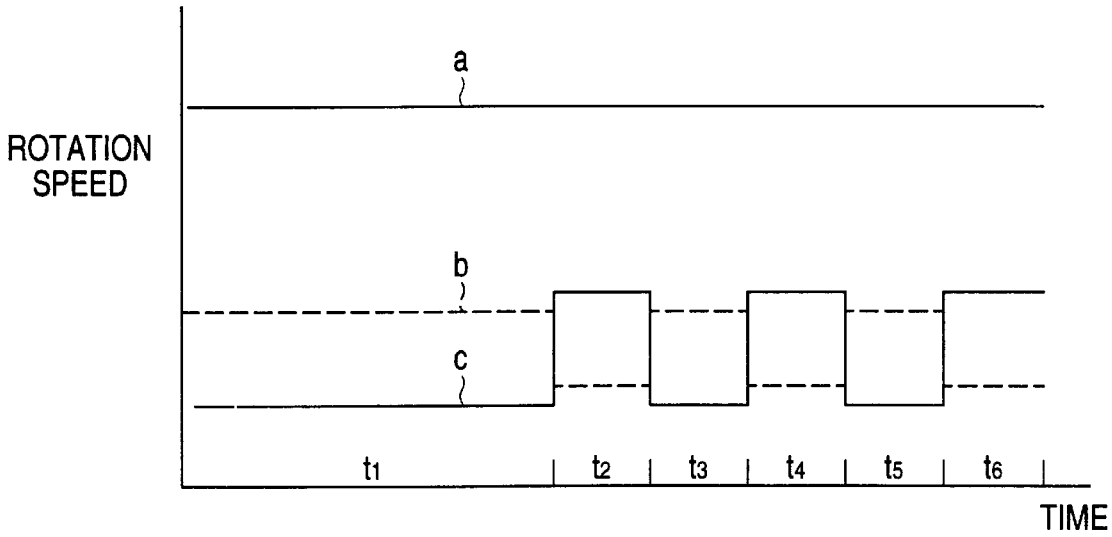
FIG. 6 is a chart to show the relationship between the number of revolutions of a press platen, an internal gear, and a sun gear of the lapping apparatus and the time in the first embodiment of the invention.
Figure 7A:
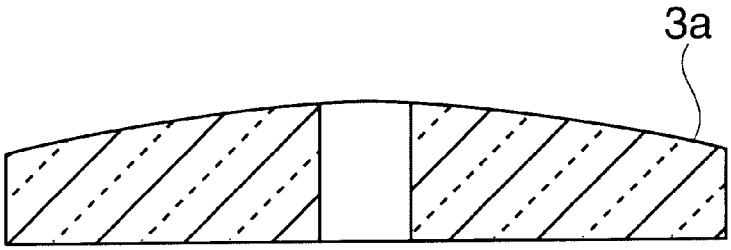
FIGS. 7(*a*)–(*c*) are sectional side views to show shape change of the lower press platen.
Figure 7B:
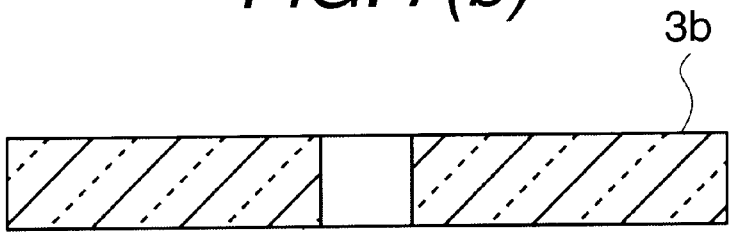
Figure 7C:
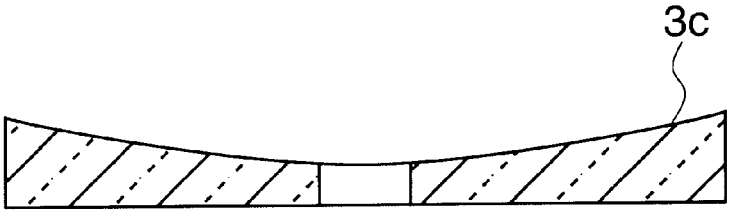
Figure 8:
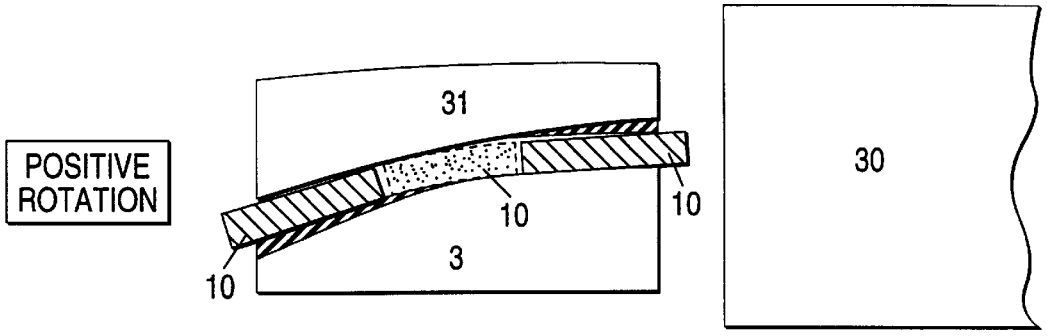
FIGS. 8(*a*)–8(*b*) are illustrations to show flatness in forward rotation and flatness in reverse rotation.
Figure 8:
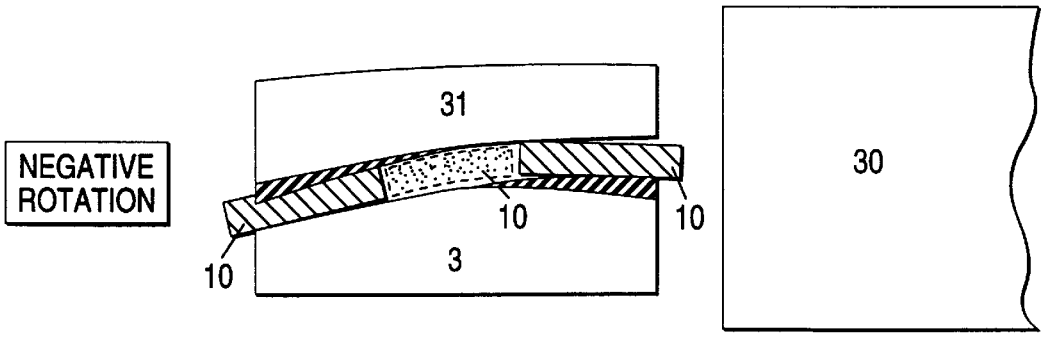

FIG. 1 is a graph to show the rotation speed of a lapping carrier in a grinding method according to a first embodiment of the invention. FIG. 2 is a perspective view of a semiconductor wafer provided by the grinding method of the embodiment. FIG. 3 is a sectional view taken on line C—C in FIG. 2. FIG. 4 is a plan view to show a lapping apparatus used with the embodiment of the invention. FIG. 5 is an illustration of the lapping apparatus. FIG. 6 is a chart to show the relationship between the number of revolutions of a press platen, an internal gear, and a sun gear of the lapping apparatus and the time. FIG. 7 is a sectional side view to show shape change of the lower press platen. FIG. 8 is an illustration to show flatness in forward rotation (positive rotation) and flatness in reverse rotation(negative rotation ).

First, a lapping apparatus used in a method of the invention will be discussed. The lapping apparatus comprises a center drum 30 rotated in one direction at a predetermined rotation speed, an upper press platen 31 and a lower press platen 3 which are rotated in opposite directions in synchronization with the center drum 30, a lapping carrier 4 being mounted between the upper press platen 31 and the lower press platen 3 and having holding holes 41 loaded with semiconductor wafers 10, a sun gear 51 and an internal gear 52 being mounted so as to gear into the margin of the lapping carrier 4 for coaxially rotating having a rotation difference to rotate the lapping carrier 4, and control means 60 for separately controlling rotation of the sun gear 51 and rotation of the internal gear 52 and abruptly changing the rotation difference between the sun gear and the internal gear, thereby controlling rotation of the lapping carrier 4 to induce rotation of the semiconductor wafers 10. A detection gage 20 for detecting flatness of the lower press platen surface is disposed in the proximity of the lower press platen 3. The detection result is input to the control means 60 so as to control the forward or reverse rotation time in response to the detection result for controlling rotation of the sun gear 51 and rotation of the internal gear 52. The upper and lower press platens rotate in conjunction with the center drum driven by a servo motor. The sun gear 51 and the internal gear 52 are also driven by the servo motor and abruptly change in the number of rotations as shown in FIG. 6. The revolution speed of the lower press platen and the rotation speed of the sun gear 51 and the internal gear 52 are shown respectively as lines a,b,c in FIG. 6. The rotation speed of the lapping carrier is determined by the rotation speed difference between the sun gear 51 and the internal gear 52.

First, the shape of the lower press platen is measured with the detection gage 20. The control means 60 performs the following calculation: For example, if the result is "A" warpage (convex) as shown in FIG. 7(*a*), total forward rotation time T1 and total reverse rotation time T2 are calculated from the warpage amount.

Next, as shown in FIG. 1, lapping times t1–t6 are input to the lapping apparatus as a lapping carrier rotation sequence and forward and reverse rotation directions and forward and reverse rotation speeds are set so that total forward rotation time T1=t2+t4+t6 and that total reverse rotation time T2=t1+t3+t5.

For the first rotation direction in the lapping, to prolong the reverse rotation time because the lower press platen is the "A" warpage (convex), the lapping time t1 until the semiconductor wafers become almost uniform in thickness is set as reverse rotation, then the substantially same lapping times t2–t6 are set so that forward rotation and reverse rotation are set alternately. Moreover, they are set so that the rotation direction is changed at a rapid rate as much as possible and that after the rotation direction is inverted, the rotation speed becomes constant.

The embodiment assumes that the lapping time t1 is 10 minutes, that the lapping times t2–t6 are each one minute, and that the inversion rate is 5 rpm/s.

The semiconductor wafers are rotated by the rapid inversion of the lapping carrier for changing the positions that the marginal portions of the upper and lower press platens abut, where by the areas lapped by the marginal portions increase. Thus, for example, a semiconductor wafer 1 having a plurality of recesses 2*a*, 2*b*, and 2*c* as shown in FIG. 2 is provided and $TTV_1$ of a far low value as compared with the TTV in the prior art can be produced as shown in FIG. 3.

The lapping can lessen a machining allowance to provide flatness in the later steps of etching and grinding and shorten the step time. We have discussed the semiconductor wafers provided by inverting several times in the embodiment; the number of inverting times and the number of recesses are increased and the depth of the recesses is decreased, whereby TTV and LTV (local thickness variation) can be furthermore improved.

From the starting of the lapping, the shape of the lower press platen becomes flat. Thus, if the lapping is repeated, degradation of flatness caused by the shape of the press platen can be prevented.

Further, a correction carrier is not required for flattening and work efficiency is good. Since flattening is corrected during the lapping, the correction carrier does not cause the press platen to wear and the service life of the press platen can be prolonged.

Next, a second embodiment of the invention will be discussed.

In a method of the second embodiment, while the rotation direction of a lapping carrier is inverted, lapping is performed and ends with a forward rotation mode.

Figure 9:
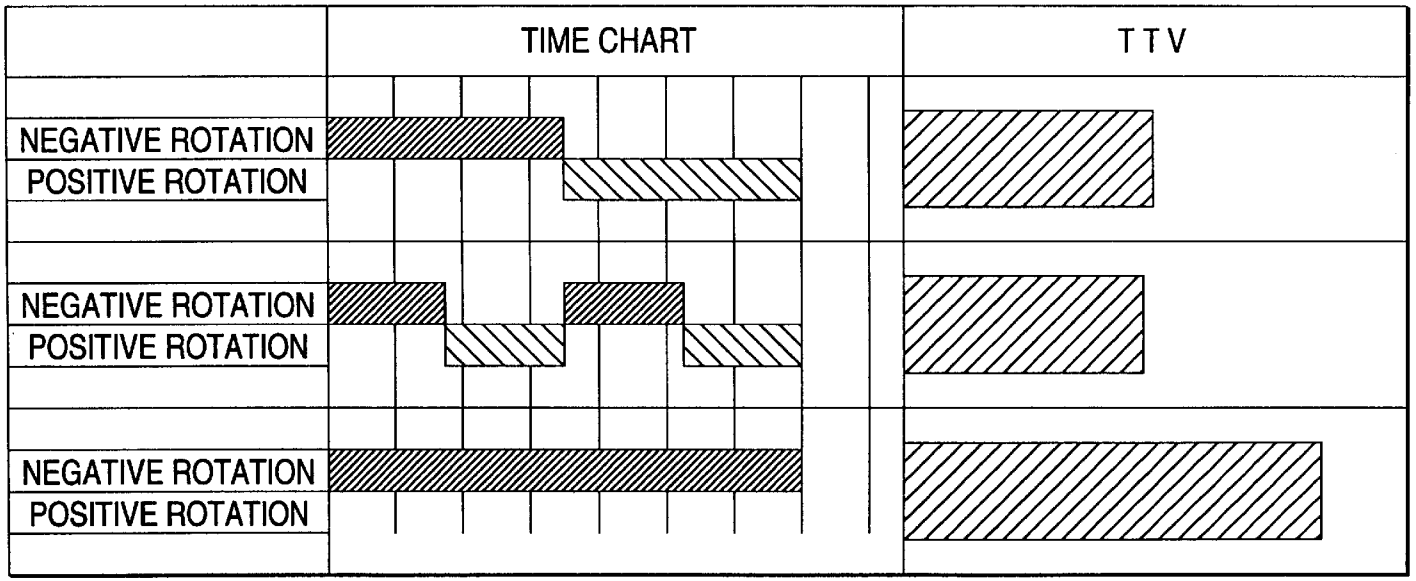
FIGS. 9(*a*)–9(*c*) are time charts to show a lapping method of a second embodiment of the invention.

That is, the rotation direction is once changed from reverse rotation to forward rotation and lapping is performed as shown in FIG. 9 indicating the relationship between change of forward and reverse rotation modes and produced surface flatness. At this time, TTV of semiconductor wafer after the lapping becomes 1.88 microns as shown in FIG. 9(*a*). In this connection, when the rotation direction of the lapping carrier is not inverted and only the reverse rotation mode is used for the lapping, TTV is 3.13 microns as shown in FIG. 9(*c*).

Further, when the rotation direction of the lapping carrier is twice inverted to measure the relationship between the inverting frequency and produced flatness, TTV is 1.83 microns as shown in FIG. 9(*b*). From the comparison between FIG. 9(*a*) and 9(*b*), it is seen that the flatness is slightly improved, but not largely improved by raising the inverting frequency.

Thus, according to the method of the invention, the rotation direction of the lapping carrier is inverted and lapping is performed and ends with the forward rotation mode, whereby highly flat semiconductor wafers with no flaws can be provided.

Figure 10:
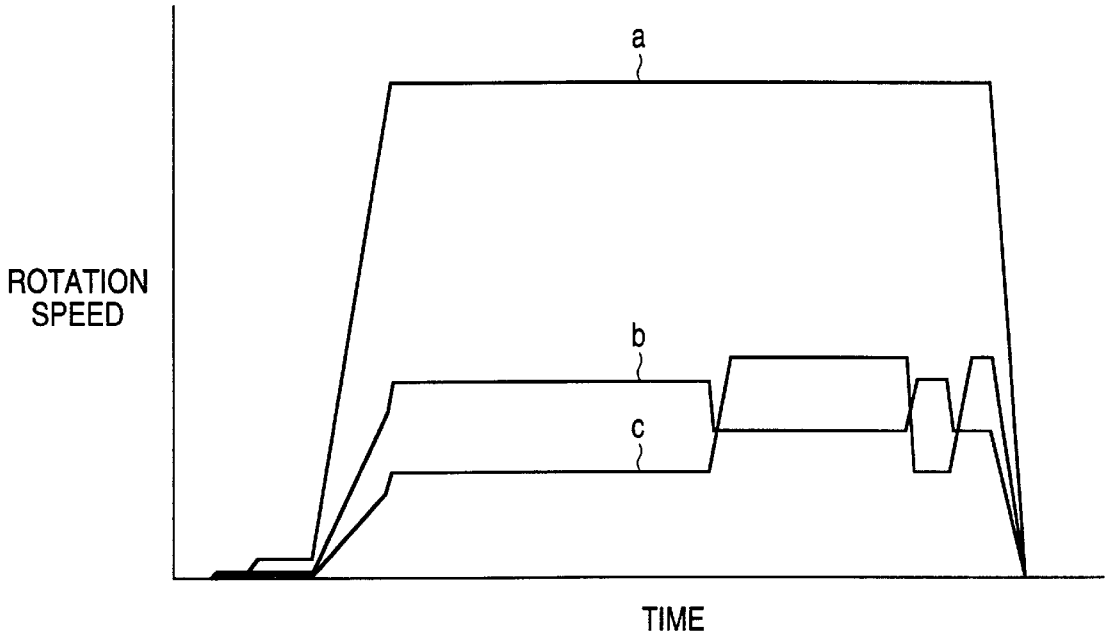
FIG. 10 is a chart to show the relationship between the number of revolutions of a press platen, an internal gear, and a sun gear of the lapping apparatus and the time in the third embodiment of the invention.
Figure 11:
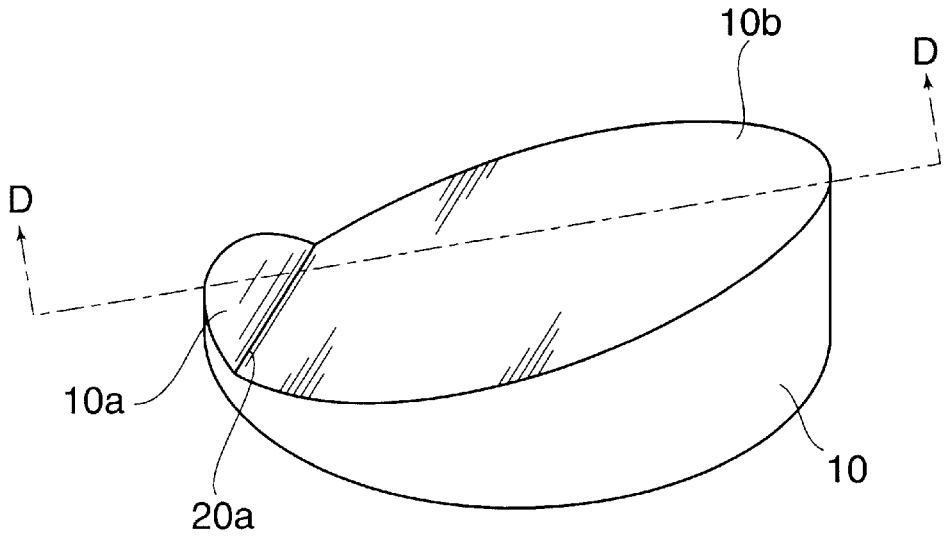
FIG. 11 is a perspective view of a semiconductor wafer provided by a grinding method in prior art.
Figure 12:
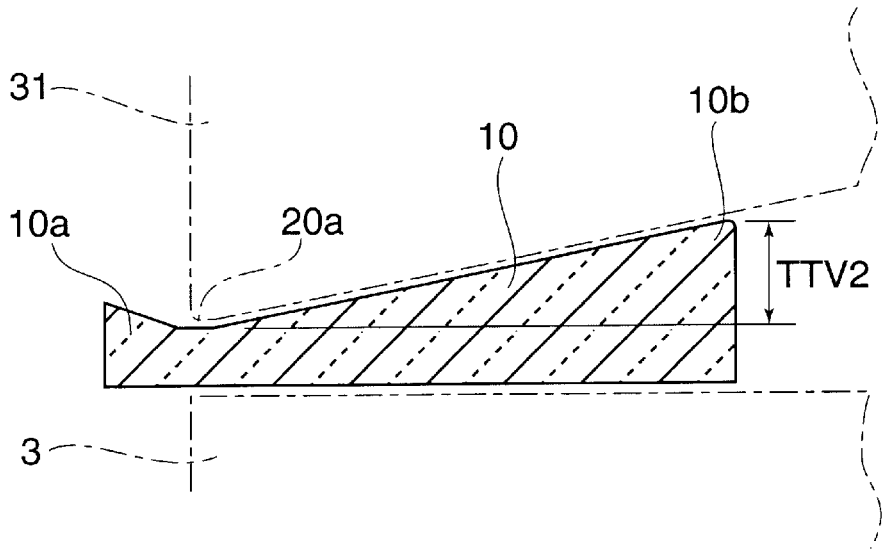
FIG. 12 is a sectional view taken on line D—D in FIG. 11.

Further, a third embodiment of the invention will be discussed. FIG. 10 is a chart to show the relationship between the number of revolutions of a press platen, an internal gear, and a sun gear of the lapping apparatus and the time in the third embodiment. In the second invention the rotation speed of the internal gear, and the sun gear of the lapping apparatus are changed abruptly. In contrast, the rotation speed of the internal gear, and the sun gear of the lapping apparatus are controlled so as to be changed gradually as shown FIG. 10. Preferably, the lapping carrier inverting speed is 0.1 rpm/s or more.

If the speed is less than 0.1 rpm/s, an impact force for causing the semiconductor wafers in the holding holes of the lapping carrier to rotate cannot be produced. More preferably, the inverting speed is 1 rpm/s, whereby it is made possible to cause the semiconductor wafers to rotate extremely efficiently.

The invention produces an excellent effect of lapping semiconductor wafers while correcting the shape of the press platen of the lapping apparatus and preventing deterioration of flatness of semiconductor wafers caused by repeating the lapping.

The rotation speed of the lapping carrier is abruptly changed during the lapping, whereby semiconductor wafers can be forced to rotate and the entire semiconductor wafer can be lapped uniformly for improving TTV and LTV. This is another excellent effect.

Further, when semiconductor wafers are lapped while the lapping carrier is rotated alternately in the forward and reverse directions, the lapping ends with the forward rotation mode, so that highly flat ground wafers with no flaws can be provided.

What is claimed is:

1. A method of lapping semiconductor wafers comprising:

placing a lapping carrier having holding holes loaded with semiconductor wafers between an upper press platen and a lower press platen which rotate in opposite directions each other;

rotating said lapping carrier; and lapping the semiconductor wafers, wherein rotation speed of said lapping carrier is abruptly changed to induce rotation of the semiconductor wafers in the holding holes of said lapping carrier.

2. The method of lapping semiconductor wafers as claimed in claim 1 wherein the rotation speed of said lapping carrier is changed by a digital controller.

3. The method of lapping semiconductor wafers as claimed in claim 1, wherein a change rate of the rotation speed of said lapping carrier is 0.1 rpm/second or more.

4. The method of lapping semiconductor wafers as claimed in claim 1, wherein a change rate of the rotation speed of said lapping carrier is 1.0 rpm/second or more.

5. A method of lapping semiconductor wafers comprising:

placing a lapping carrier having holding holes loaded with semiconductor wafers between an upper press platen and a lower press platen which rotate in opposite directions;

rotating said lapping carrier; and lapping the semiconductor wafers, wherein said lapping carrier is controlled so as to rotate alternately in forward and reverse directions and rotate in the forward direction at a last step.

6. The method of lapping semiconductor wafers as claimed in claim 5, wherein the rotation speed of said lapping carrier is changed by a digital controller.

7. The method of lapping semiconductor wafers as claimed in claim 6, wherein rotation speed of said lapping carrier after inversion is held substantially constant and rotation in one direction is maintained for at least five seconds.

8. A method of lapping semiconductor wafers comprising:

placing a lapping carrier having holding holes loaded with semiconductor wafers between an upper press platen and a lower press platen which rotate in opposite directions from each other;

rotating said lapping carrier;

lapping the semiconductor wafer;

measuring a shape of said lower press platen before lapping is started;

selecting a rotation direction of said lapping carrier and total rotation time in each rotation direction so that a deformation self-correction for said lower press platen is made based on the measurement result; and controlling said lapping carrier so that said carrier rotates alternately in forward and reverse directions and the rotation time in the forward direction and the rotation time in the reverse direction become substantially the same as the selected rotation time based on the measurement result and lapping the semiconductor wafers while making a deformation self-correction for said lower press platen.

9. The method of lapping semiconductor wafers as claimed in claim 8, wherein said lapping step controls so that the rotation direction of said lapping carrier becomes forward at a last step.

10. The method of lapping semiconductor wafers as claimed in claim 9, wherein the rotation speed of said lapping carrier is changed by a digital controller.

11. The method of lapping semiconductor wafers as claimed in claim 10, wherein rotation speed of said lapping carrier after inversion is held substantially constant and rotation in one direction is maintained for at least five seconds.

* * * * *